US006459076B1

(12) United States Patent
Schlenker

(10) Patent No.: US 6,459,076 B1
(45) Date of Patent: Oct. 1, 2002

(54) ON-BOARD CAMOUFLAGE LIGHTING SYSTEM USING DIRECTIONAL LIGHT SOURCES

(76) Inventor: Wesley E. Schlenker, 919 Knott Pl., Dallas, TX (US) 75208

( * ) Notice: Subject to any disclaimer, the term of this patent is extended or adjusted under 35 U.S.C. 154(b) by 0 days.

(21) Appl. No.: 09/494,014

(22) Filed: Jan. 28, 2000

(51) Int. Cl.[7] ..... H04N 7/18; G01J 1/32

(52) U.S. Cl. ..... 250/205; 250/208.1; 348/122; 472/61

(58) Field of Search ..... 250/205, 552, 250/553, 208.1, 208.2; 348/122, 586; 472/61

(56) References Cited

U.S. PATENT DOCUMENTS 5,307,162 A * 4/1994 Schowengerdt ..... 348/122

FOREIGN PATENT DOCUMENTS

FR 2733311 A1 * 12/1992

* cited by examiner

*Primary Examiner*—Stephone Allen
*Assistant Examiner*—Bradford Hill

(74) *Attorney, Agent, or Firm*—Duke W. Yee; Patrick Holmes

(57) ABSTRACT

An object uses light transmitters to control the visible image of the object in order to camouflage the object or to otherwise deceive the vision of observers. The color and intensity of the light emitted from the object is determined by its background, which would otherwise provide a contrast with the object when viewed by an observer. Light sensors uptake the color and intensity of the object's background and pass that information to controllers that determine the color and intensity of light to be transmitted to achieve the desired camouflage effect, and pass the output color to the light transmitters on the opposite side of the object. Transmitters may be placed on the object at right angles to the surface of the object, thereby allowing for only a single color shading at any point on the object, and providing effective camouflage for the object only when viewed straight-on or against a background that does not vary when viewed from oblique viewing angles. Alternatively, the light transmitters may have narrowly-focused beams and may instead be placed at various oblique angles which allow the object to be perceived as having different color shadings, at the same point on the object, when observed from different viewpoints. This allows any surface of the object to be camouflaged against any of its backgrounds as seen from multiple different viewing angles.

27 Claims, 6 Drawing Sheets

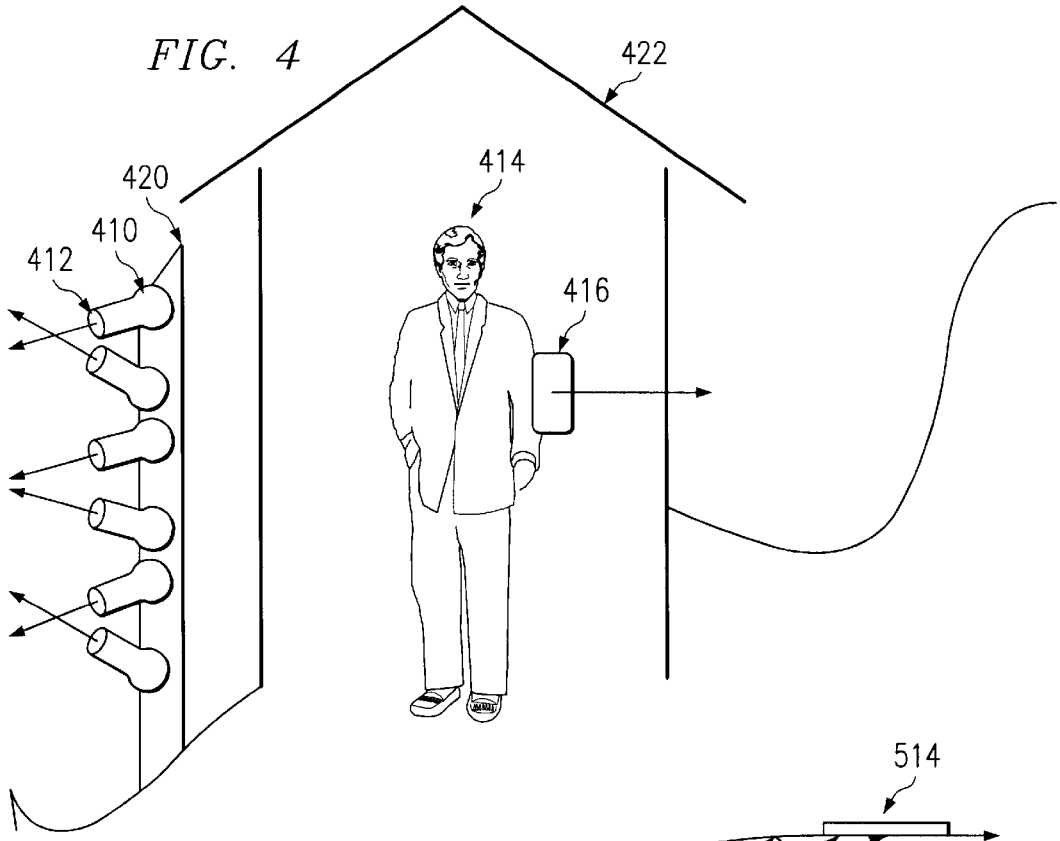
FIG. 4
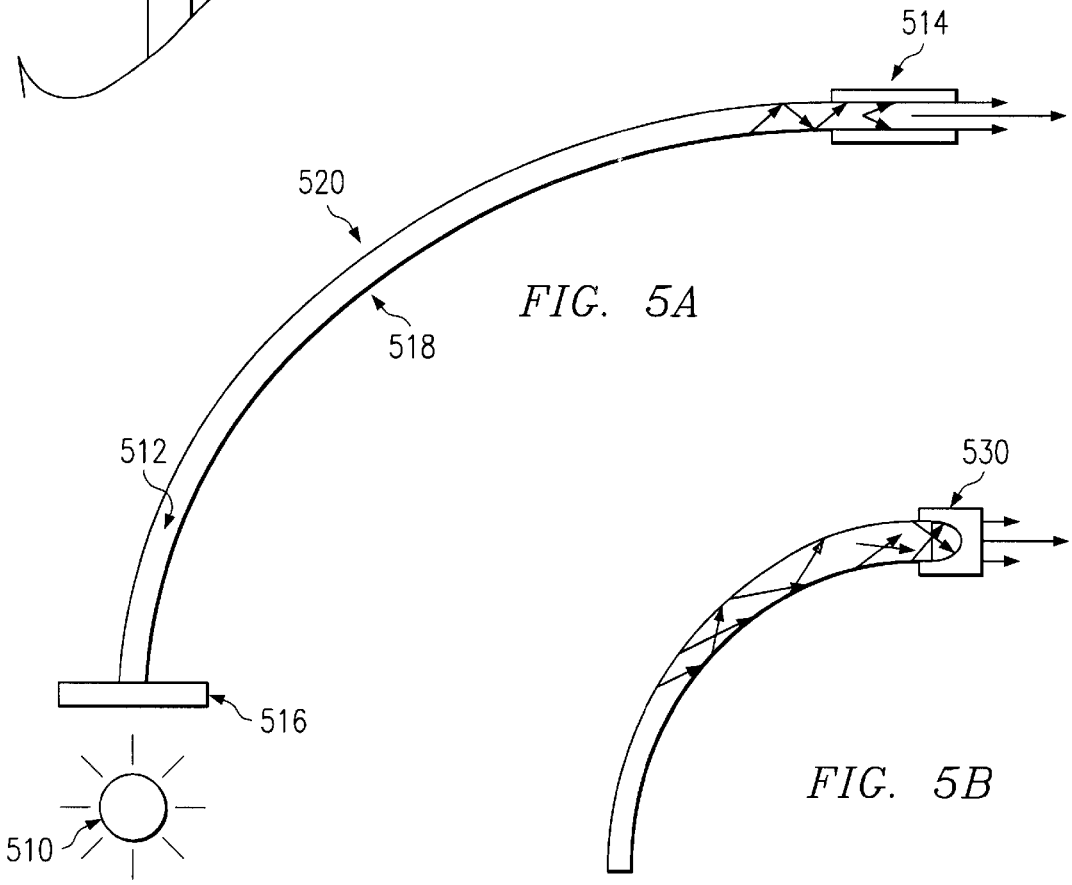
FIG. 5A
FIG. 5B

ON-BOARD CAMOUFLAGE LIGHTING SYSTEM USING DIRECTIONAL LIGHT SOURCES

BACKGROUND OF THE INVENTION

1. Technical Field

The present invention relates to camouflage. More particularly, the present invention relates to reactive camouflage. Still more particularly the present invention relates to a method and system for disguising an object using reactive camouflage.

2. Description of Related Art

During World War II, allied torpedo bomber aircraft were assigned the task of hunting and sinking German submarines on the surface of the open ocean. The bombers were largely unsuccessful because submarine lookouts could see the bombers from a distance, silhouetted against a bright sky, allowing the submarines ample time to dive to safety. An allied invention using one element contained in the present invention was used to greatly increase the number of German submarines that were sunk by torpedo bombers. A row of simple incandescent lights was placed on the leading edge of the wing of the torpedo bombers to fill in the forward-facing silhouette of the torpedo bomber with light. After this invention was implemented, German submarine captains reported that they could hear the engines of the torpedo bomber before they could see it.

In order to camouflage an object to blend with its background when viewed by the human eye, it is generally accepted that the contrast between the object and its background must be reduced. In order to reduce the contrast, the color and intensity of the light coming from the object toward the viewer's eye must simulate the color and intensity of the light coming toward the viewer's eye from the background immediately behind the object. Most methods of camouflage vary the shape, texture and surface color of an object in order to make it reflect light in such a manner that the viewer sees a color and intensity of reflected light (also known as diffuse reflection and/or specular reflection) similar to the object's background. Traditional camouflaging techniques provide passive color shading and, therefore, cannot react to changing backgrounds which silhouette a moving object. Furthermore, passive camouflage cannot fill in light, which has been blocked by the object, or increase lighting levels when the object is less radiant than its background.

Another, potentially serious problem with current camouflage techniques is that a camouflaged object has approximately the same color shading from any angle. This is a critical flaw for a moving object that gives observers different views of the object against different backgrounds. While an object may be obscured from one observer by its camouflage pattern, a second observer from a second vantage point might distinguish the object against a different background with different lighting conditions, even though the two observers are roughly equal distances from the object.

It is important to understand that, in many regional conflicts, the weaponry utilized by the adversaries is less technologically advanced. Most regional armies rely upon weapons that require visual acquisition of a target. These weapons are generally less effective at longer ranges, so the longer it takes for an advisory to detect an object and identify the object as a threat, the less chance that the advisory can bring weapons to bear on the object before it moves out of range.

It would be advantageous to provide an object with a camouflage that matches the lighting intensity of the object's background by actively generating such intensity of light as may be appropriate to the object's background. It would also be advantageous to provide an object with a camouflage, which varies in color and intensity with the viewpoint from which an observer views the object, providing simultaneously differing images in differing directions. It would also be advantageous to provide an object with a camouflage which utilizes its capability of projecting simultaneously differing images in differing directions to vary in color and intensity with varying background changes as the object moves from one position to another with respect to the observer. It would be further advantageous to utilize such advanced projection techniques to create an image that is intentionally visible, but which creates an illusion to mimic some other object.

SUMMARY OF THE INVENTION

In accordance with an illustrative embodiment of the present invention, a camouflage system comprises variable light transmitters covering the surface of an object, which are used to blend the object with its background, making it difficult to visually distinguish from its background. Variable light transmitters covering an object are each individually controlled by a controller, which varies the light color and intensity coming from the light transmitters. In order to blend the object with its background, light sensors are placed on the opposite sides of the object, and paired through a controller or controllers to individual light transmitters. Each light sensor senses the color and intensity of light coming from one side of an object, and a controller uses this information to vary the color and intensity of light transmitted from a paired light transmitter on the opposite side of the object, exactly matching the color and intensity of background light. For example, if a viewer sees the object against a bright blue sky, the light transmitters covering the object which are facing the viewer would be transmitting bright blue light to match the background light as sensed by paired sensors on the opposite side.

Note that "color and intensity" of light in the description of the present invention means the specular power distribution, luminance, and other specular characteristics of light. Note also that the matching of colors in the present invention is metameric color matching, meaning that the simulated colors need not have specular characteristics identical in every way to the original color, but need only appear to the human eye to be a perfect match because of the limited range of color sensitivity in the human eye and other psychophysical and psychological factors.

In some applications a viewer may view the object from an oblique angle, seeing the object against different background light than would be seen if viewed from a "straight on" view at a right angle to the surface of the object. In order to allow for camouflage from oblique views, light sensors and transmitters are designed to be directional and are designed to receive or transmit light at varying angles. Each light transmitter transmits light rays outward essentially parallel to a single axis. Transmission of light outward from light transmitters that do not create diffuse light, but transmit light in a narrow dispersion of nearly parallel light rays, can be accomplished with a variety of existing technologies. For example, light sources can be equipped with lenses or view limiting devices so that only nearly parallel light rays are emitted from individual light transmitters, and light can only be viewed by viewers directly in line with a light transmitter's aiming path. Light sensors are similarly fitted with lenses or view limiting devices so that light is only sensed from sources directly in line with the aiming path of each sensor. A light transmitter with an aiming path that is at a right angle to the surface of the camouflaged object is varied by a controller to match light measured by sensors on the same aiming axis as the transmitter but with an aiming path pointed in the exact opposite direction on the opposite side of the object. Light transmitters with an aiming path that is at an oblique angle to the object would be varied by a controller to match light measured by sensors on the same axis as the transmitter, but with an aiming path pointed in exactly the opposite direction. Light transmitters with aiming paths at a variety of angles are interspersed in close proximity to each other on the surface of the object so that transmitted light originating from all parts of the surface of the object would be visible to a viewer from any perpendicular or oblique viewing angle, without any "blank" spots visible on the object from any angle.

As an alternative to individual placement, directional transmitters may be grouped in tightly integrated clusters, with each cluster containing enough light transmitters aimed outward at varying angles to transmit light in a near-180 degree semispherical pattern. "Blank" spots would be avoided by covering the entire surface of the object with tightly integrated clusters. In addition, to avoid "blank" spots when viewing the object from various oblique angles, individual transmitters must not transmit light in perfectly parallel light rays, but must allow a small aspect angle light dispersion. The size of the aspect angle dispersion would correspond to the angular displacement between light transmitters occupying a single cluster on the surface of the object. Each cluster may also contain directional light sensors paired to transmitters on the various other sides of the object. Each cluster could be thought of as a "pixel" similar to the concept of a pixel on a video monitor, except that each cluster would contain multi-directional light transmission capability. Each such modular cluster will be termed a "directional pixel" in connection with the present invention. Any application of a "directional pixel" in the present invention may also be accomplished using a non-integrated grouping of directional light transmitters and receivers arranged in a variety of aiming paths such that the same coverage is achieved as with integrated directional pixels.

In applications where the entire surface of the object is covered by both sensors and light transmitters, the transmission of light may reflect off of moisture, dust, smoke or other objects and interfere with the light sensors mounted on the same side of the object. As an alternative, in order to avoid light reflection back toward sensors in certain applications, the light transmitters do not transmit light continuously. Instead, the transmitters transmit light in a very rapid succession of light bursts (such as strobes flashing in excess of 30 times per second) that appears as continuous light or nearly continuous light to the human eye, yet allows a very short interval in between light bursts for the light sensors to obtain readings that are not influenced by outwardly-transmitted light. Alternating the light sensing cycle with the light transmission cycle also allows use of the same light transmission channel, such as an optical fiber, for both reception of light to be sensed at a central location, and transmission of light outward from a central location.

It should be noted that the type of light transmitters used by the system may be virtually any type of light source that could be made available in the application, such as the light transmission technologies currently utilized by a wide variety of audio-visual equipment, which produces light over all or most of the range of the visible light spectrum (or is capable of being filtered or modified in such a way that it produces light over most or all of the range of the visible light spectrum). The choice of light source depends on the complexity of the camouflage system that has been implemented, the level of resolution that is needed, and the frequency of camouflage update that is needed.

For example, light transmitters for a stationary system with slow update and low resolution may be simple incandescent bulbs, with light output varied by color filters and with apertures or electrical power regulators which are controlled with manual inputs after a human controller takes manual readings from light sensors pointed in the opposite direction. In such an example, the "light controller" would be direct human input. As another example, light transmitters for a moving system with rapid update and resolution requirements may be supplied with light by a centrally mounted strobe light or series of strobe lights with light channeled to directional transmitters on the surface of the object by means of optical fibers, with color and intensity varied by means of liquid quartz display technology or any other light filtering technology with rapid update capability. Similarly, light could be generated at a central location in such a manner that it is directional (essentially parallel light rays) and reflected outward in selected directions by computer controlled movable mirrors utilizing systems currently in use in a variety of audio-visual or electronic cinematographic applications.

Additional computer processing capability, memory, and programming may be added to the present invention beyond what is needed for the basic control features, such that continuous adjustments may be made to the appearance of the object to enhance the camouflage by eliminating or reducing the effects of sunlight or other light reflected from the surface of the object (specular reflection and diffuse reflection which is referred to in the terminology of video image processing as viewing flare). In addition, substantial enhancements in image processing could allow the present invention to project an image on the surface of the object to make the object clearly visible, but with an appearance that is totally different from the camouflaged object, such as projecting the image of six enemy helicopters flying in formation onto the surface of a camouflaged military air transport aircraft, providing a plausible visible cue to match its radar echo while allowing it to land and depart from an enemy airfield in daylight without detection.

In order to compensate for viewing flare (passively reflected light from the surface of the object, both specular reflection and diffuse reflection) the computer processing unit could monitor light sensor input to determine the direction of the primary light sources and calculate which directions the light is likely to be reflected from the object and detected by a viewer. Existing algorithms have been developed in computer gaming, CAD-CAM and image simulation fields, such as the Phong model or the Torrance-Sparrow model, to determine the characteristics of light reflected from an object with a defined shape and defined reflective qualities. These are often referred to as "shading models". After utilizing existing algorithms to determine the quality and direction of reflections from the surface of the object which is to be camouflaged (these passive reflections being known in the video monitor field as "viewing flare"), light transmitters aimed in the same direction as the anticipated reflections could be varied in color and intensity to mitigate the unintended reflection (canceling or reducing the effects of the "viewing flare"). Existing algorithms are commonly available and utilized in the field of computer video image processing to adjust light transmitted from a video screen to reduce the effects of viewing flare. These algorithms are commonly used to mitigate the effect of grey-white reflections from the surface of a monitor which require adjustment of the image displayed on the monitor in order to accurately reproduce the intended spectral qualities to be viewed by the human observer. Since viewing flare is generally white light, the existing algorithms generally result in shifting the color of transmitted light away from white (toward more saturated colors). In simplified terms, the effect of the viewing flare is cumulative with the image projected from the viewing surface, so in order to compensate for the viewing flare the spectral power distribution of the viewing flare is subtracted from the spectral power distribution of the image to be projected from the viewing surface in order to determine the appropriate adjusted spectral power distribution of the image to be projected.

As an alternative method of reducing reflections, surface panels on the object could also be physically tilted or otherwise physically modified as directed by the processing unit to redirect and minimize especially noticeable specular reflection.

Intentionally visible images could also be created by the on-board processing unit. In essence, the entire surface of the object could be treated as a near-spherical video viewing monitor, covered with directional pixels which are cumulatively capable of simulating a three dimensional object. In such an application, image generation could be controlled by a series of parallel processors instead of a single image processor, because added capacity may be necessary in order to project a slightly different image in each of the directions the light transmitters are oriented, accurately reproducing essentially all views of a three dimensional object.

As an example of this type of application, part of the surface of a military helicopter may be camouflaged to match its background while the remainder of its light transmitters may project an intentionally visible image that would make the helicopter appear to an observer to have the same shape and color as an enemy aircraft (from all viewing angles). Similarly, depending on the needs of the mission, a three dimensional image could be projected on the surface of the helicopter to simulate a flock of birds, an aircraft that has been hit and is engulfed in flames or a flying billboard with pictures or text which may be animated. If a high level of resolution is implemented, for example, a mobile missile launcher may be outfitted to appear to a viewer as a line of enemy tanks.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 4 depicts an example of one preferred embodiment of the present invention that realizes the advantages of the present invention without the use of an automated controller;

FIGS. 5A and 5B illustrate light transmitters attached to a view-limiting device and a lens, respectively, which are used to limit transmission of light to a single aiming path in a specific direction, with minimal bleed-over to other directions;

DETAILED DESCRIPTION OF THE PREFERRED EMBODIMENT

The detailed description of the present invention is divided into three sections. Section A describes the arrangement and coordination of the light sensors and transmitters, and the primary role of the control unit(s). Section B describes alternative methods of light sensing and transmission. Section C describes additional functionality of the control system, which enhances the camouflage or creates a highly visible image to transform the viewable appearance of the object.

A. Arrangement and Coordination of Light Sensors and Transmitters

Figure 1A:
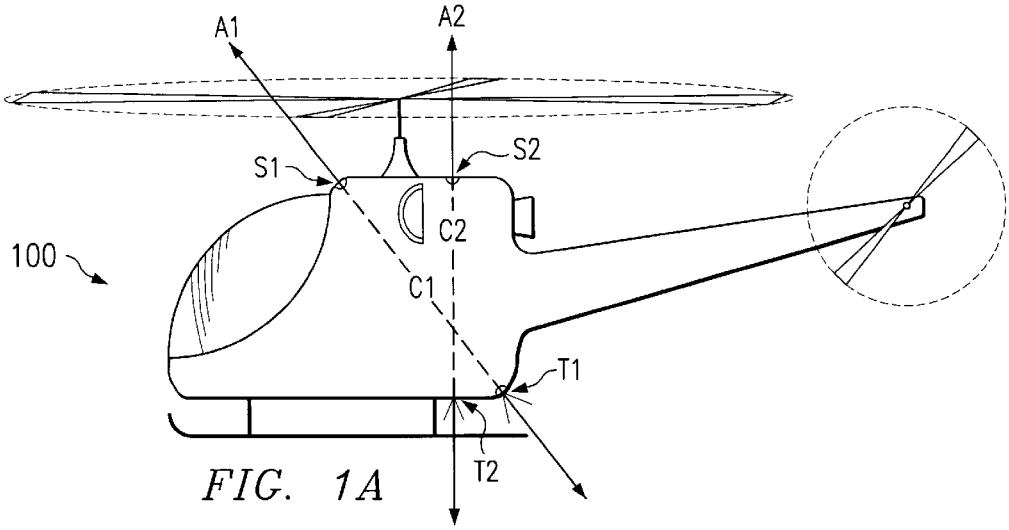
FIGS. 1A and 1B illustrate an object covered with light transmitters and light sensors mounted only at right angles to the surface of the object.
Figure 1B:
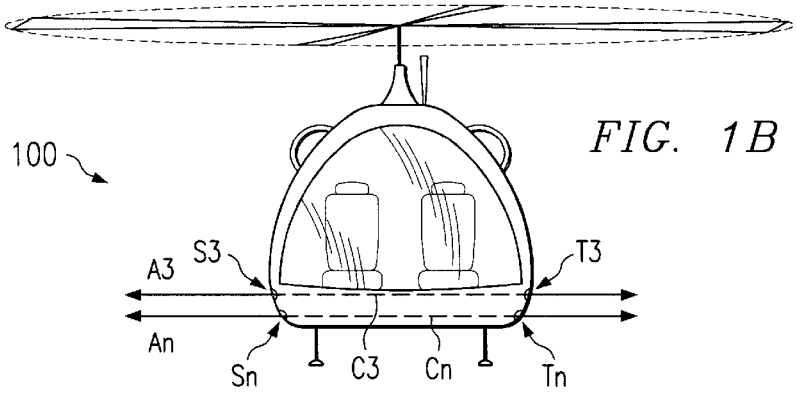

FIGS. 1A and 1B illustrate an object covered with light transmitters and light sensors mounted only at right angles to the surface of the object. FIGS. 1A and 1B depict helicopter 100, which is covered with light sensors S1, S2, S3, . . . Sn and light transmitters T1, T2, T3, . . . Tn. The light emitted from each light transmitter is controlled by controllers C1, C2, C3, . . . Cn. Sensor S1 senses the color and intensity of light on one side of the object; controller C1 receives the input from sensor S1; and controller C1 varies the color and intensity of light transmitted by light transmitter T1 on the opposite side of the object, to match the color and intensity of light sensed by sensor S1. Similar pairings are reproduced with as much resolution and transmitter density as desired, with light transmitters covering as many surfaces of the object as are intended to be camouflaged.

This pairing of light sensor and transmitter utilizes background light sensors to sense the background color and intensity of light behind an object, and to adjust light transmitters facing the opposite direction of the background light sensors so that the viewer's eye sees light of the same color and intensity coming from the object as the viewer would see coming from immediately behind the object if it were not blocked by the object. For example, if a viewer sees the object against a bright blue sky, the light transmitters covering the object which are facing the viewer would be transmitting bright blue light to match the background light as sensed by paired sensors on the opposite side.

Note that "color and intensity" of light in the description of the present invention means the specular power distribution, luminance, and other specular characteristics of light. Note also that the matching of colors in the present invention is metameric color matching, meaning that the simulated colors need not have specular characteristics identical in every way to the original color, but need only appear to the human eye to be a perfect match because of the limited range of color sensitivity in the human eye, and other psychophysical and psychological factors.

In the present embodiment, light transmitters are affixed to the surface of helicopter 100 at right angles to the surface. In this embodiment, a light transmitter must have a corresponding sensor from which to receive a color and-intensity input. In order that the transmitted light beam have the proper color and shading for its background, the light sensor must be facing exactly the opposite direction of the light transmitter, i.e. it must be oriented approximately 180 degrees from the horizontal orientation of the transmitter and approximately 180 degrees from the vertical orientation of the transmitter. This oriented pair of transmitter and sensor is shown by sensor S1 and transmitter T1 on axis A1, while sensor S2 and transmitter T2 lie on axis A2.

FIG. 1B depicts a frontal view of helicopter 100. Here, axis A3 and An are parallel. Both transmitter T3 and transmitter Tn receive color and intensity inputs from sensors which are proximate and of like orientation.

Therefore, in a further refinement of the present invention, single sensors may provide input for several transmitters that are oriented in parallel.

Regardless of the input sensor type, the overall appearance of the object must mimic its background to be effective. That is to say, the combination of the passively reflected light (viewing flare) from the object, blended with transmitted light, must appear as background to an observer.

Controlling the final appearance of the object is performed by the controllers. Although FIGS. 1A and 1B represent individual controllers between pairs of transmitters and receivers, in an alternative embodiment of the present invention output control is provided by a single control processor. That processor performs the tasks of interpreting the location, color, and intensity of light measured by the sensors, determining transmitter locations which should be paired to the measurements from particular sensors, calculating appropriate adjustments to color and intensity of light to compensate for passively reflected light (to be described in more detail later), and finally, providing control inputs to appropriate light transmitters to make the object appear to be of the same color and intensity of light as its background when viewed from any side.

In some applications, a viewer may view the object from an oblique angle, seeing the object against different background light than would be seen if viewed from a "straight on" view at a right angle to the surface of the object. In order to allow for camouflage from oblique views, light sensors and transmitters are designed to be directional and are mounted at varying angles. Each light transmitter transmits light rays outward, essentially parallel to a single axis. This is accomplished by utilizing one of a variety of existing technologies. For example, light sources can be equipped with refracting lenses or view limiting devices, so that only mostly parallel light rays are emitted from individual light transmitters, and so that light can only be viewed by viewers directly in line with a light transmitter's aiming path. Light sensors are similarly fitted with refracting lenses or view limiting devices so that light is only sensed from sources directly in line with the aiming path of each sensor. A light transmitter with an aiming path that is at a right angle to the surface of the camouflaged object is varied by a controller to match light measured by sensors on the same aiming axis as the transmitter but with an aiming path pointed in the exact opposite direction on the opposite side of the object. Light transmitters with an aiming path that is at an oblique angle to the object would be varied by a controller to match light measured by sensors on the same axis as the transmitter but with an aiming path pointed in exactly the opposite direction. Light transmitters with aiming paths at a variety of angles are interspersed in close proximity to each other on the surface of the object so that transmitted light originating from all parts of the surface of the object would be visible to a viewer from any perpendicular or oblique viewing angle, without any "blank" spots visible on the object from any angle. "Blank" spots would also be avoided by allowing "parallel" light transmissions to experience a slight dispersion, with the angle of incidence of the dispersion pattern corresponding to the angular displacement between light transmitters occupying a single region on the surface of the object.

Figure 2:
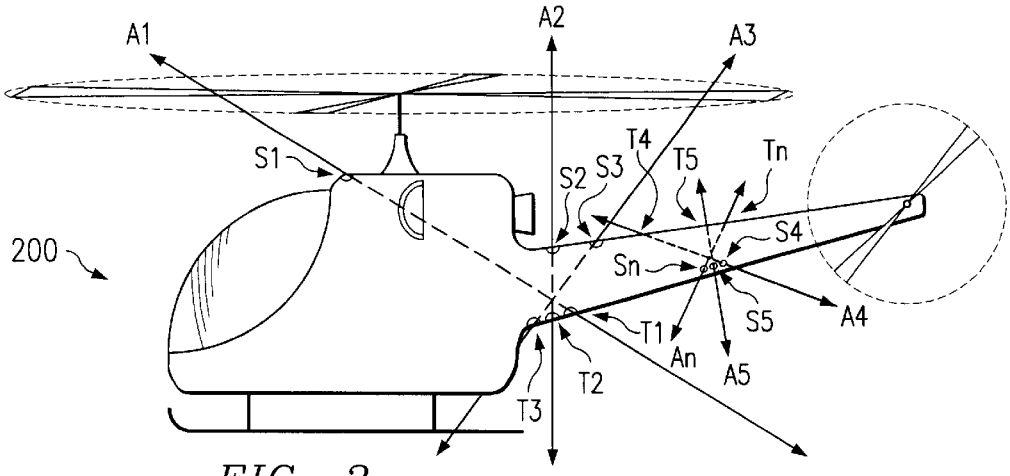
FIG. 2 illustrates an object covered with light transmitters and light sensors mounted at various angles from the surface of the object, some at right angles to the surface of the object and others at oblique angles to the surface of the object.

FIG. 2 illustrates an object covered with light transmitters and light sensors mounted at various angles from the surface of the object, some at right angles to the surface of the object and others at oblique angles to the surface of the object. Sensor S1 is paired through controller C1 (not shown) to light transmitter T1. T1 is aimed in exactly the opposite direction but on the same axis A1 as the aiming path of sensor S1. Sensor S2 is paired through controller C2 (not shown) to light transmitter T2. T2 is also aimed in exactly the opposite direction but on the same axis A2 as the aiming path of sensor S2. Even though transmitters T1 and T2 are mounted on the surface of the object immediately adjacent to each other, the sensors to which they are paired are not adjacent to each other. It is necessary to follow a transmitter's aiming axis backward through the object to determine the location of the sensor to which it is paired. Since T1 and T2 are mounted at differing oblique angles, the locations of the sensors to which they are paired are not adjacent on another side of the object. Similarly, sensors S3, S4, S5 and Sn are paired through controllers to transmitters T3, T4, T5 and Tn in the proper locations on other surfaces of the object and with the proper aiming paths as are dictated by the location and aiming path of the sensors.

As an alternative to individual placement, directional transmitters may be grouped in tightly integrated clusters, with each cluster containing enough light transmitters aimed outward at varying angles to transmit light in a near-180 degree semispherical pattern. Each cluster may also contain directional light sensors paired to transmitters on the various other sides of the object. The clusters are distributed over the entire surface of the object that is to be camouflaged. Each cluster could be thought of as a "pixel," similar to the concept of a pixel on a video monitor, except that each cluster would contain multi-directional light transmission capability. Each such modular cluster is termed a directional pixel in connection with the present invention. Any application of a "directional pixel" in the present invention may also be accomplished using a non-integrated grouping of directional light transmitters and receivers arranged in a variety of aiming paths, such that the same coverage is achieved as with integrated directional pixels.

In applications where the entire surface of the object is covered by both sensors and light transmitters, the transmission of light may reflect off of moisture, dust, smoke, or other objects and interfere with the light sensors mounted on the same side of the object. This "feedback" of transmitted light through the light sensors causes unwanted distortions in the transmitted light color and intensity as the controllers attempt to reproduce the color and intensity of the reflected light rather than the unintentionally obscured background light. As an alternative, in order to avoid light reflection back toward sensors in certain applications, the light transmitters do not transmit light continuously. Instead, the transmitters transmit light in a very rapid succession of light bursts (such as strobes flashing in excess of 30 times per second) that appear as continuous light or nearly continuous light to the human eye, yet allow a very short interval in between light bursts for the light sensors to obtain readings that are not influenced by outwardly-transmitted light. Alternating the light sensing cycle with the light transmission cycle also allows use of the same light transmission channel, such as an optical fiber, for both reception of light to be sensed at a central location and transmission of light outward from a central location.

Figure 3:
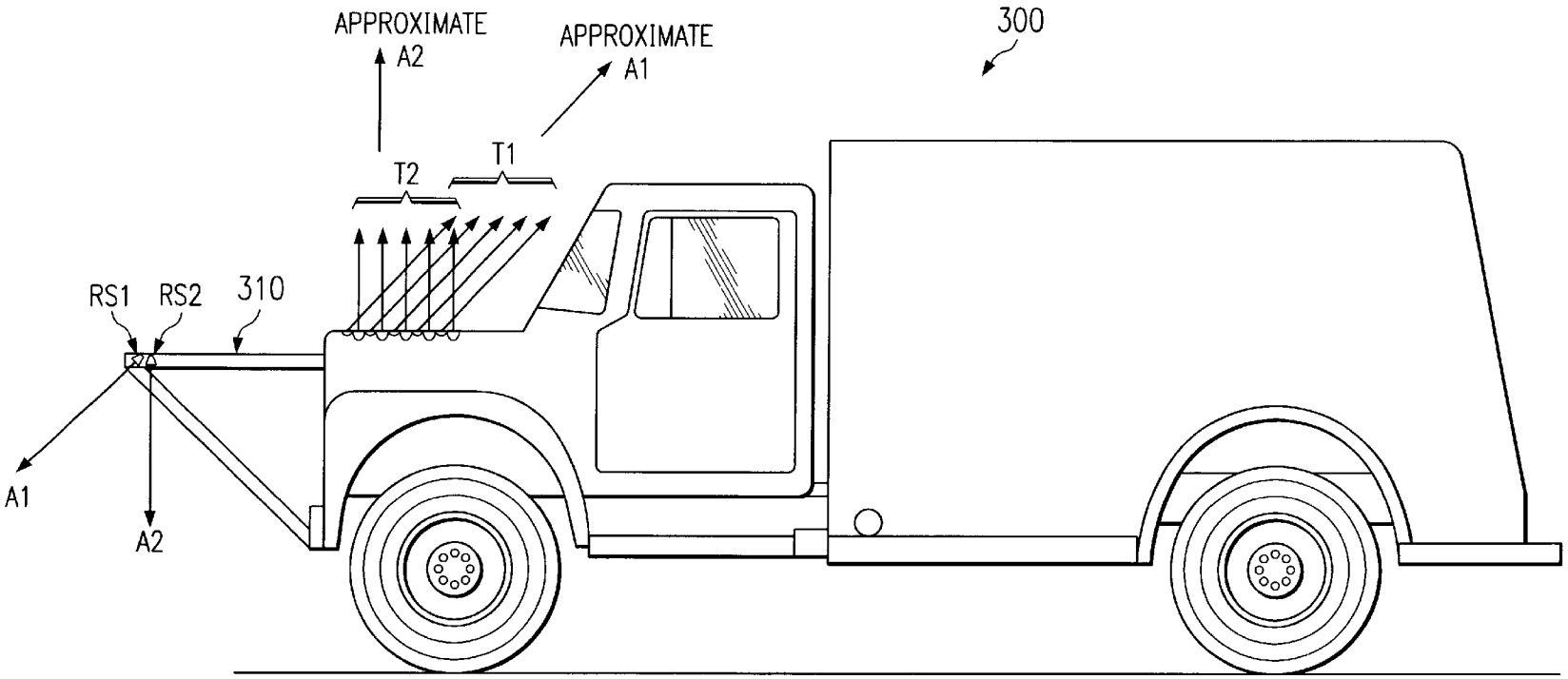
FIG. 3 illustrates the placement of remote sensors, which sense the background of the object that is immediately to the side of the object rather than directly behind the object.

FIG. 3 illustrates the placement of remote sensors that sense the background of the object, which is immediately to the side of the object, rather than directly behind the object. Here, truck 300 is fitted with boom 310. Controllers receive input from remote sensors RS1 and RS2, which are not mounted on the opposite side of the object from the transmitters, but on extended boom 310. In applications where the object comes in close proximity to the surface or where an object is in close proximity to its background, the possibility exists that the sensors will sample light color and intensity from a shadow created by the object. By remotely placing the sensors away from shadows created by the object itself, more accurate background color and intensity values are obtained by the sensors and, thus, the transmitted colors and intensities more closely resemble the background.

In FIG. 3, remote light sensor RS1 is used as input for controllers which control multiple light transmitters T1, which share a common off-center approximate axis; and remote light sensor RS2 is used as input for controllers which control multiple light transmitters T2, which share the same off-center approximate axis. Remote sensor data may be transmitted by wire, by fiber optic data cable, by a radio communication device, or by any other means of communication.

In applications similar to those depicted in FIG. 1 and FIG. 2, the same pairing of multiple light transmitters (which are pointed in a common direction) to a single light sensor may also be accomplished if high resolution is not required, or in applications where the object is not likely to cover more than one type of background as viewed from a single vantage point as would occur, for example, if a large blimp passed in front of a tall building while a portion of the craft remained silhouetted against the sky. In other words, if the application does not demand sensors covering the entire surface of the object, a single sensor could be paired to all of the transmitters with a parallel axis pointed in the opposite direction (not necessarily sharing the same axis), with the total number of sensors corresponding to the total number of discrete angular displacements represented by the transmitters. In such a simplified application, the number of sensors could be further reduced by use of one or more CCD imagers (such as a video camera with a wide-angle lense). A CCD imager is a sensory matrix constructed of rows and columns of sensory elements, fitted with a refracting lense that changes the input orientation of the light across the CCD elements. Each sensory element or group of elements from the CCD sensory matrix could represent a single light sensor, allowing for light sensors from a wide range of angular displacements to be replaced by a single CCD imager. If the CCD imager could be practically replicated and installed in such a way that CCD imager input lenses cover the entire surface of the object, CCD imager input could be utilized in more complex applications, as well.

For an airborne object, such as a helicopter, camouflage controllers may be switched from on-board sensor inputs to remote, boom-mounted sensor inputs similar to those depicted in FIG. 3 as the object nears the ground, particularly for inputs sensed in the opposite direction of the prevailing light source, which would be likely to obtain misleading light readings caused by the shadow cast by the object as it nears the ground.

In an alternative embodiment, known background characteristics are stored on a memory device and replayed when the information from light sensors is unreliable. For instance, vehicles traveling on a dirt or asphalt highway may use an appropriate highway background stored in memory rather than using light sensor information which has been degraded by the vehicle's own shadow or dust emanating from under the vehicle.

B. Alternative Methods of Light Sensing and Transmission

The present invention is not limited to a single method of light production or to a single means for variation of the color and intensity of light. Any technology, which is capable of producing light and varying light output in color and intensity in the visible light spectrum, may be implemented as a light transmission in the present invention. Several examples are presented below, which do not limit the methods of light production that may be used in the present invention.

Apart from the physical methods for sensing and transmitting light, various methodologies exist for measuring, classifying, recording, and reproducing the specular characteristics of light, generally known as colorimetry. For example, in 1931, the Commission Internationale de l'Eclairage (International Commission on Illumination, or CIE) adopted one set of color-matching functions to define a Standard Colorimetric Observer, whose color-matching characteristics are representative of those of the human population having normal color vision utilizing a 2-degree field of view. This allowed for the development of CIE tristimulus values X; Y; Z, which further enabled the production of measurement equipment, recording methods, and color display systems for standardized metameric color matching. This methodology was enhanced with a 1964 Supplementary Standard Colorimetric observer, covering a viewing angle of 10 degrees, to be used for calorimetric measurements and calculations related to relatively large areas of color. The CIE also has recommended the use of other color coordinate systems derived from XYZ, in which visual differences among colors are more uniformly represented. These systems include the CIE 1976 u', v' uniform-chromacity-scale diagram, and the CIE 1976 L*a*b* (CIELAB) color space.

In addition to the CIE calorimetric systems, various proprietary systems have been developed. By way of example, the Kodak Photo YCC Color Interchange Space is widely used for the general electronic interchange of color images. Other example systems include $YC_bC_r$ Space, Cineon System PD Space, and NIFRGB Space (used in the FlashPix format). A calorimetric system, whether CIE standard or proprietary, is utilized in the present invention to consistently measure, record, and reproduce light that is a metameric match with the background of an object. In addition to utilizing one of many different colorimetric systems, the present invention may be implemented with widely varying physical equipment.

FIG. 4 depicts a preferred embodiment of the present invention that realizes the advantages of the present invention without the use of an automated controller. In this embodiment, a series of simple incandescent lights are used for providing a lighted camouflage for a structure. Incandescent lights 410, such as might be used in a theater, may be equipped with a lens or series of lenses to direct light in a single direction, removable colored gel frames or the like to vary the color of light, and an aperture or stage light dimmer to vary the intensity of light (all shown as 412). Lights 410 are mounted on temporary scaffold 420 within close proximity to structure 442, which is to be camouflaged. The structure or the scaffolding would be modified, if possible, to be non-reflective, such as by covering it with non-reflective black fabric. Operator 414 takes manual light, color and intensity readings from the opposite direction from which each light is aimed. Operator 414 uses light meter 416, which can be aimed with directional precision. After taking a reading, operator 414 adjusts the color and intensity of light from lights 410 facing the opposite direction by adjusting the lights' adjustable apertures or electrical dimmer, and by placing the correct colored gel in the gel frame. Lenses may also be used in much smaller applications, since any type of lens combination which has the effect of focusing light in a narrow beam with essentially parallel light rays may be used in the present invention.

FIGS. 5A and 5B illustrate light transmitters attached to a view-limiting device and a refracting lense, respectively, which are used to limit transmission of light to a single aiming path, in a specific direction, with minimal bleed-over to other directions. In a preferred embodiment depicted in FIG. 5A, light source 510 emits a light beam that is variably controlled for color and intensity by light filter 516. The light beam then passes into fiber optic strand 520, which consists of a core material 512 and a cladding 518. The light beam travels through fiber optic strand 520 by reflecting from one side of cladding 518 to the other. Consequently, as the light beam exits fiber optic strand 520, the beam is scattered into divergent light rays, many of which are not oriented in the necessary direction. Therefore, fiber optic strand 520 is terminated with view limiting device 514, which absorbs the divergent light rays. Only parallel light rays are transmitted from view limiting device 514. In this embodiment, a tube with a light absorbing coating is used for eliminating the divergent light rays.

As can be imagined, the amount of absorbed light must be allotted for when calculating the light intensity by light filter 516. FIG. 5B illustrates an alternative to the tube type view limiting device 514, which is a lense utilized to refract divergent light rays rather than absorbing them. Here, fiber optic strand 520 is terminated with lens 530, which is specially shaped based on existing lense design technology to focus divergent light coming from the end of the fiber optic strand. The shape of lens 530 refracts the divergent light rays into parallel light rays, thereby losing very little intensity as opposed to methods where the divergent light rays are absorbed.

More complex view limiting devices may be used in a miniaturized version of the present invention, as may be required by the light source. Miniaturized lenses are readily available to fit the tips of fiber optic cables and are currently used for the process of mating two optical fiber ends. Similar miniaturized lenses can be manufactured and fitted to the ends of fiber optic cables for the purpose of transmitting light outward from the tip of an optical fiber, such that all light rays are essentially parallel to each other.

Figure 6:
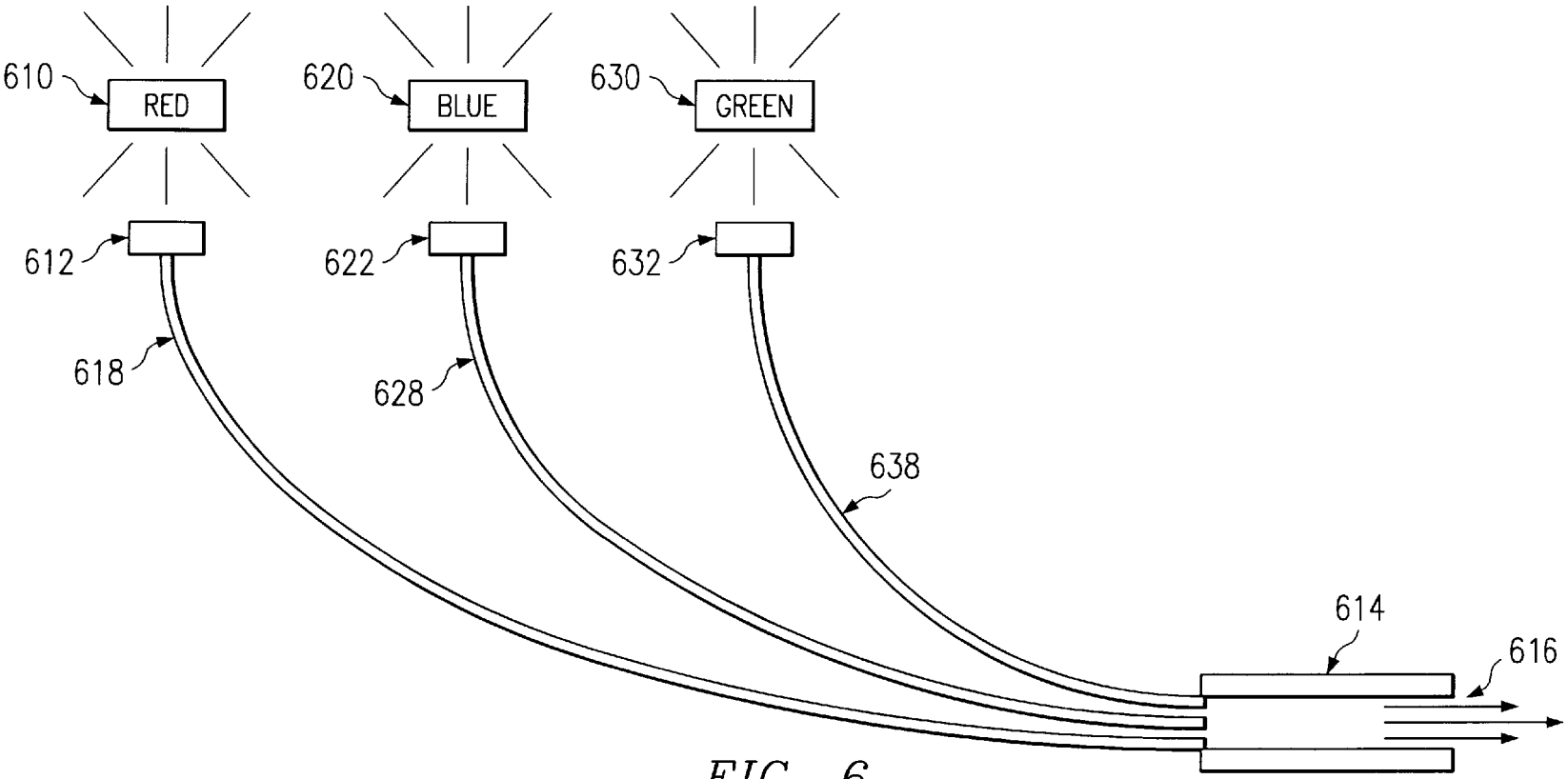
FIG. 6 depicts a combined light source in accordance with an example of one preferred embodiment of the present invention.

FIG. 6 depicts a combined light source in accordance with an example of a preferred embodiment of the present invention. Here, rather than employing a single variable color filter for coloring the light with a single light channel, three light channels are used, each commencing with a light source that is either red 610, blue 620, or green 630. The beam generated by each light source is filtered by variable density filters 612, 622 and 632, such as LCDs, which terminate the source end of fiber optic strands 618, 628 and 638. Density filters 612, 622 and 632 are controlled by a controller, such that the proper mix of red, blue and green light is transmitted to view limiting device 614. Only parallel light rays of the required color are emitted through view combined light transmitter 616.

Instead of controlling the color of the light by means of a variably colored filter, each of the three lights is affixed with a filter of constant color. The controller varies then varies color of the combined light transmitter by varying the relative intensity of the three lights, either by varying the intensity of the light produced at its source or by varying the relative density of light filter used on the each of the three lights. This example of a preferred embodiment illustrates only one of many ways that existing technology could be used to vary the color and intensity of transmitted light.

Figure 7:
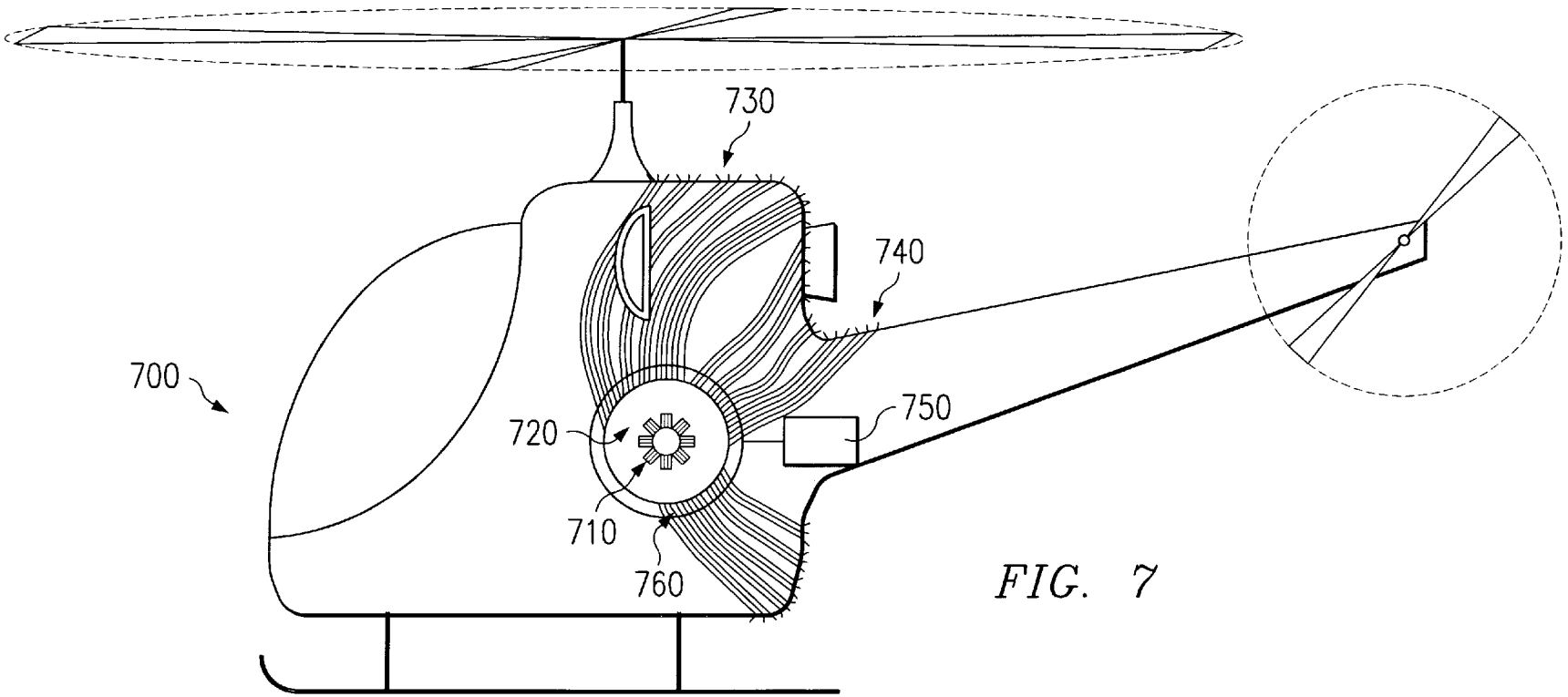
FIG. 7 illustrates generation of multi-directional reactive camouflage lighting from a central control and light generation location and distributed to the surface by means of optical fibers, in accordance with a preferred embodiment of the present invention.

FIG. 7 illustrates generation of multi-directional reactive camouflage lighting in accordance with a preferred embodiment of the present invention. Depicted here is helicopter 700, which is fitted with onboard reactive camouflage. Light for the reactive camouflage is generated by a plurality of strobe lights 710, which are housed within reflective housing 720. The individual strobe lights in light cluster 710 fire within reflective housing 720 in sequence or otherwise at a combined rate of, for example, 30 flashes per second. The light beams pass through individually controllable color and density light filter bank 760 at the strobe-end of fiber optic bundles 730. Controller 750 adjusts the density and color of individual elements in filter bank 760, which individually varies the color and intensity transmitted from each output axis of the directional pixels 740, which are clusters of multiple terminating optical fibers, each with directional lenses or view limiting devices for focusing the light coming from a single fiber into a single axis or aiming path. Light sensors (not shown) are co-located with controllable color and density light filter bank 760 at the termination end of the fiber optic bundles 730. During dormant periods, when the strobes are not flashing, the light sensors gather intensity and color information about the background. The density and color of the filters are controlled by controller 750, using the information gathered by the light sensors.

Strobe lights 710 are mounted at a central location on an aircraft, flashing in sequence, such that it appears to a human eye to be a constant source of light, which may be accomplished if the strobes flash at a combined speed of, for example, 30 flashes per second. Fiber optic light receptors gather light from the strobe flashes and deliver the light to directional light transmitters 740 on the surface of helicopter 700. Light filtering for the desired color and intensity may be accomplished at a central location where the light originates, such as in filter bank 760, or at the termination point of the light on the skin of the aircraft, in multiple filter points. Filter bank 760 could be replaced with other equipment which accomplishes the objective of directing light from the strobes to appropriate fiber optic termination points while simultaneously modifying the color and intensity of light delivered to each fiber optic termination point. Current digital cinematographic projection equipment utilizing tiny mirrors individually controlled to change pixel color and intensity, could be modified for this application.

In order to compensate for viewing flare (i.e., passively reflected light from the surface of the object, both specular reflection and diffuse reflection), the computer processing unit monitors light sensor input to determine the direction of the primary light sources and calculate which directions the light is likely to be reflected from the object and detected by a viewer. Existing algorithms have been developed in computer gaming, CAD-CAM and simulation fields, such as the Phong model or the Torrance-Sparrow model, to determine the characteristics of light reflected from an object with a defined shape and defined reflective qualities. These are often referred to as "shading models." After utilizing existing algorithms to determine the quality and direction of reflections from the surface of the object, light transmitters aimed in the same direction as the anticipated reflections (the viewing flare) could be varied in color and intensity to mitigate a noticeable reflection.

Existing algorithms are commonly available and utilized in the field of computer video image processing to adjust light transmitted from a video screen to reduce the effects of viewing flare. These algorithms are commonly used to mitigate the effect of gray-white reflections from the surface of a monitor, which requires adjustment of the image displayed on the monitor in order to accurately reproduce the intended spectral qualities to be viewed by the human observer. Since viewing flare is generally white light, the existing algorithms generally result in shifting the color of transmitted light away from white (toward more saturated colors). In simple terms, the effect of the viewing flare is cumulative with the image projected from the viewing surface, so (in simplified terms) in order to compensate for the viewing flare, the spectral power distribution of the viewing flare is subtracted from the spectral power distribution of the image to be projected from the viewing surface in order to determine the appropriate adjusted spectral power distribution of the image to be projected.

As an alternative method of reducing reflections, surface panels on the object could also be physically tilted with respect to the light source or otherwise physically modified as directed by the processing unit to redirect and minimize especially noticeable specular reflection.

Other adjustments may be utilized in the event a camouflage system does not have the resolution, intensity, or color matching ability necessary to make it virtually disappear against its background. In the event the camouflage system displays such limitations in a particular application, the present invention may be implemented in such a way as to create strategically placed patterns on the object. The patterns deviate slightly from the color-matching camouflage processes described above. Their purpose, rather than completely disguising the object as its background, diverts the human eye from recognizing lines, shape changes, and outer silhouette. The system softens recognizable shape features of the object which provide cues utilized by human vision for pattern recognition.

It should be noted that the type of light transmitters used by the system may be virtually any type of light source that could be made available in the application, which produces light over all or most of the range of the visible light spectrum (or is capable of being filtered or modified in such a way that it produces light over most or all of the range of the visible light spectrum). The choice of light source depends on the complexity of the camouflage system that has been implemented, the level of resolution that is needed, and the frequency of camouflage update that is needed.

For example, light transmitters for a stationary system with slow update and low resolution may be simple incandescent bulbs, with light output varied by color filters and with apertures or electrical power regulators which are controlled with manual inputs after a human controller takes manual readings from light sensors pointed in the opposite direction. In such an example, the "light controller" would be direct human input. As another example, light transmitters for a moving system with rapid update and resolution requirements may be supplied with light by a centrally mounted strobe light or series of strobe lights with light channeled to directional transmitters on the surface of the object by means of optical fibers, with color and intensity varied by means of liquid quartz display technology or any other light filtering technology with rapid update capability. Similarly, light could be generated at a central location in such a manner that it is directional (parallel light rays) and reflected outward in selected directions by computer controlled movable mirrors utilizing systems currently in use in a variety of applications. Additional computer processing capability, memory, and programming may be employed by the present invention beyond what is needed for the basic control features, such that continuous adjustments may be made to the appearance of the object to enhance the camouflage by eliminating or reducing the effects of sunlight or other light reflected from the surface of the object (specular reflection and diffuse reflection, which are referred to in the terminology of video image processing as viewing flare).

C. Added Control System Functionality

In addition, the present invention may be employed to project an image on the surface of the object in accordance with a preferred embodiment. The image makes the object clearly visible but with an appearance that is totally different from the camouflaged object. For instance, the present invention may be utilized to project the image of six enemy helicopters flying in formation onto the surface of a camouflaged military air transport aircraft and providing a plausible, visible cue to match its radar echo while allowing it to land and depart from an enemy airfield in daylight without detection.

Intentionally visible images are created by the onboard processing unit in accordance with a preferred embodiment of the present invention. In essence, the entire surface of the object could be treated as a near-spherical video viewing monitor, covered with directional pixels which are cumulatively capable of simulating a three dimensional object. In such an application, image generation could be controlled by a series of parallel processors instead of a single image processor, because added capacity may be necessary in order to project a slightly different image in each of the directions the light transmitters are oriented, accurately reproducing essentially all views of a three-dimensional object.

Figure 8:
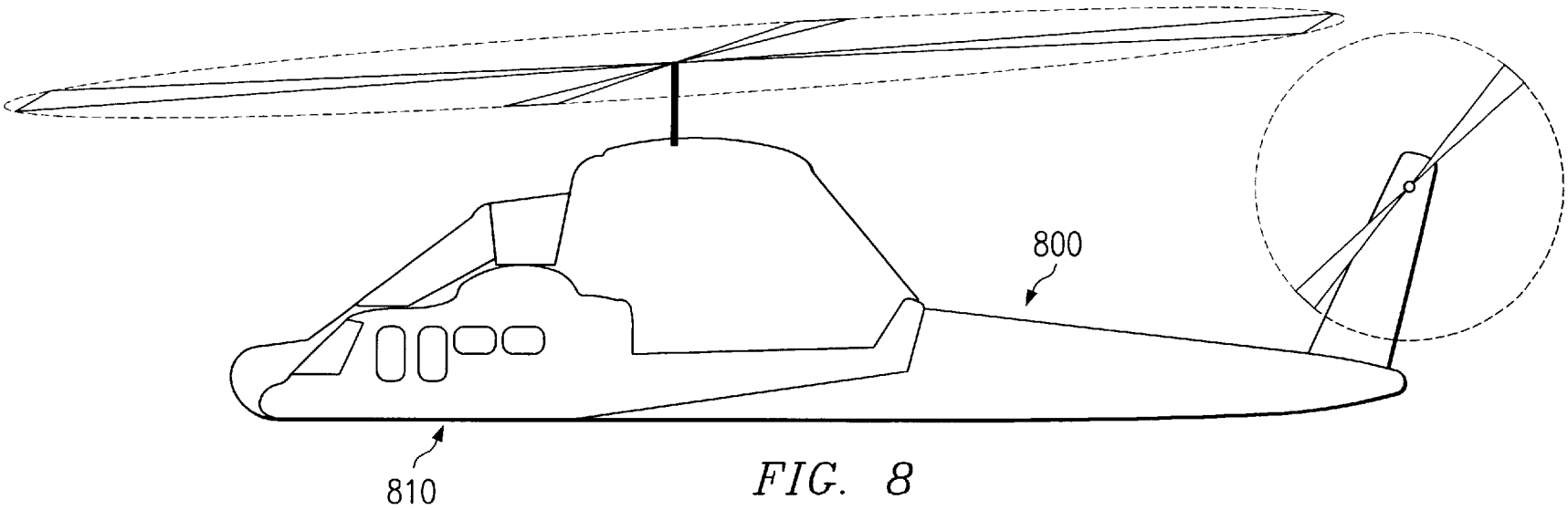
FIG. 8 provides an illustration of how the ability of the present invention to camouflage an object by transmission of light may also provide the necessary means to present an intentionally visible image which may confuse, deceive, frighten, inform or entertain.

FIG. 8 provides an illustration of how the ability of the present invention to camouflage an object by transmission of light may also provide the necessary means to present an intentionally visible image which may confuse, deceive, frighten, inform or entertain. FIG. 8 illustrates that, with the use of directional light transmitters with sufficient density and resolution on the surface of a mobile object, an image of a three dimensional object can be projected onto the surface of the object from multiple simultaneous perspectives. Initially, an illustrator, animator, or photographer captures or creates an image of an object from multiple different perspectives, with the intention of creating an illusion from the images. Each perspective view of the illusory image is split into pixels. A central processor sends information regarding the color and intensity of each pixel to the appropriate light controller; and the color and intensity of light is varied in the appropriate light transmitter or transmitters that are directed in a common direction which corresponds to the perspective of the illusion being reproduced.

In the depicted figure, real military helicopter 800 is shaded with a perspective image of illusory civilian helicopter 810. Many different perspectives of an image of a civilian helicopter could be transmitted outward from each of the surfaces of a military helicopter. The number of additional perspectives of the illusory image to be reproduced is limited primarily by the number of aiming angles utilized by light transmitters of the camouflage system on the aircraft. Because the image of the civilian helicopter is smaller than the entire surface of the military helicopter, the extra surface area of the military helicopter is filled in with the ordinary camouflage light transmissions which are generated to match background light sensors as set forth in Section A above. Similarly, other multi-dimensional illusory images may be created and programmed into the controller of the camouflage system, such as an image of the camouflaged aircraft on fire, an image of a flying saucer, or an image that is commonly associated with hallucinations, with the intention of creating hesitation, confusion, or lack of credibility in witnesses.

As another example, an aircraft carrier's appearance may be changed to look like an island, or to look like a civilian cargo freighter. As a final example, objects traveling in formation could be programmed to be highly visible in the direction of other friendly objects in the same formation, while remaining camouflaged in all other directions.

As described in connection with FIGS. 4, 5, 6 and 8, any technology which is capable of varying the color and intensity of light by means of a variable light filtering scheme may be deployed as a way of controlling the color and intensity of light transmitters which are supplied with light by a strobe in the present invention. The advantage of a strobe light or series of lights as a light source is that a brighter intensity of light can be created, allowing the object to nearly camouflage itself when passing between the sun and the viewer, virtually erasing its own shadow. Another advantage with using a strobe light is that the light sensor readings are taken in the fractional second between each strobe pulse so that the light radiating outward from the camouflage system does not reflect off of dust, moisture, or other objects and interfere with the readings of the light sensors. A third advantage of using a strobe or pulsating light transmitter is that the same light channel, such as an optical fiber, can be used for channeling light to a centrally mounted light sensor as is used to channel light outward from a central light source.

The description of the present invention has been presented for purposes of illustration and description but is not intended to be exhaustive or limited to the invention in the form disclosed. Many modifications and variations will be apparent to those of ordinary skill in the art. The embodiment was chosen and described in order to best explain the principles of the invention and the practical application, and to enable others of ordinary skill in the art to understand the invention for various embodiments with various modifications as are suited to the particular uses contemplated.

What is claimed is:

1. A reactive camouflage system, comprising:

a plurality of external light transmitters affixed to a surface of an object;

at least one light sensor for receiving information relating to lighting conditions on the opposite side of the object; and at least one controller for receiving the information relating to light conditions on the opposite side of the object and for adjusting at least one of the external light transmitters based on the information wherein the at least one light sensor is directional, receiving light from a single direction, and wherein the plurality of external light transmitters are directional, each transmitting light beams in their individual target directions.

2. The camouflage system of claim 1, wherein the at least one sensor is mounted remotely from the object.

3. The camouflage system of claim 2, wherein the at least one sensor is not on a direct axis with any of the plurality of directional lights, but wherein the sensor receives light input from a representative background.

4. The camouflage systems of claim 1, wherein the at least one controller input is stored on a memory for use later as a representative background.

5. The camouflage system of claim 1, wherein a source of light for the plurality of external light transmitters is strobe light emissions.

6. The camouflage system of claim 1, wherein a source of light for the plurality of light transmitters is located on the surface of the object.

7. The camouflage system of claim 1, wherein a source of light for the external light transmitter is remotely located, and wherein light beams are transmitted to the plurality of external light transmitters via optical fibers.

8. The camouflage system of claim 5, wherein readings from the at least one light sensor are taken between pulses from the strobe light.

9. The camouflage system of claim 1, wherein the at least one light sensor is located on the surface of the object.

10. The camouflage system of claim 7, wherein the at least one light sensor is located remotely from the surface of the object via optical fibers.

11. The camouflage system of claim 1, wherein the directional light transmitters are clustered together in groupings of various aiming angles, providing for a full complement of directional transmission angles in each modular cluster of transmitters.

12. The camouflage system of claim 11, wherein the groupings of directional light transmitters also contain groupings of directional light sensors.

13. The camouflage system of claim 1, wherein light beams emitted from the plurality of external light transmitters vary by color of a filter through which light passes.

14. The camouflage system of claim 1, wherein the external light transmitters each create variation in color by combining three or more lights of differing color and by varying the relative intensity of such individual lights within the sub-group of lights.

15. The camouflage system of claim 14, wherein the external light transmitters create variation in color by varying the relative intensity of the individual lights at their source, rather than by blocking or limiting light output after it has been generated.

16. The camouflage system of claim 14, wherein the external light transmitters create variation in color by varying a light filter density associated with the individual lights or other device which blocks, diffuses, or fails to transmit light in a manner which is variable and controllable.

17. The camouflage system of claim 1, wherein the light transmitted from at least one of the plurality of external light transmitters is adjusted to minimize the visibility of light reflections on a surface of the object.

18. The camouflage system of claim 17, wherein the adjustment for reflections on the surface of the object is performed by a real-time calculation of expected direction, intensity, and specular characteristics of reflected light; by utilizing, 1) a shading model or algorithm, 2) a mathematical representation of the shape of the object to be camouflaged, 3) reflective characteristics of the surface of the object, and 4) real-time measurement data regarding the direction(s) and specular characteristics of external light sources which illuminate the object to be camouflaged, and which may result in reflections on the surface of the object; wherein the results are to adjust the intensity of the light transmitted from at least some of the plurality of external light transmitters.

19. The camouflage system of claim 18, wherein a variety of light source directions and specular characteristics are stored in a table, and the expected reflections to be generated from each such source are associated with the stored values in the table, such that a majority of the real-time processing to determine such expected reflections is not necessary and is accomplished in advance, allowing for less complex table-look-up processing, keyed off of actual lighting conditions encountered.

20. The camouflage system of claim 19, wherein the table is constructed from real-time observation of the object to be camouflaged (rather than by predictions from a shading model or algorithm), measuring the direction, location, and specular characteristics of each reflection generated from a variety of light source directions and specular characteristics.

21. The camouflage system of claim 19, wherein said table is constructed utilizing shading models or algorithms and a mathematical representation of the surface of the object to be camouflaged, loading the values into the table in advance, or on a near-real-time basis, utilizing a range of expected or approximate lighting conditions the object is experiencing or is expected to experience during a given period in time, allowing for less complex real-time table-look-up processing, keyed off of actual lighting conditions encountered.

22. The camouflage system of claim 1, wherein the directional light transmitters utilize an optical lens.

23. The camouflage system of claim 1, wherein said directional light transmitters utilize a view-limiting device.

24. The camouflage system of claim 1, wherein an illusory image of a second object to be imitated by the camouflaged object is projected from at least some of the plurality of external light transmitters.

25. The camouflage system of claim 24, wherein portions of the object which are not covered by the illusory image continue to be controlled by the at least one controller to match the color and intensity of background light.

26. The camouflage system of claim 24, wherein multiple images of the second object are obtained or generated from a variety of perspectives, and are projected from the appropriate multiple different directional perspectives of the object.

27. The camouflage systems of claim 24, wherein the illusory image of the imitated object is animated.

* * * * *